United States Patent [19]

Deem

[11] Patent Number: 4,908,964

[45] Date of Patent: Mar. 20, 1990

[54] CALIFORNIA TYPE SHOE WITH CONTOURED MIDSOLE

[75] Inventor: John Deem, Chestnut Hill, Mass.

[73] Assignee: Interco Incorporated, St. Louis, Mo.

[21] Appl. No.: 231,970

[22] Filed: Aug. 15, 1988

[51] Int. Cl.[4] ..... A43B 7/14

[52] U.S. Cl. ..... 36/88; 36/22 A; 36/25 R; 36/93

[58] Field of Search ..... 36/18, 21, 25 R, 88, 36/93, 103, 12, 19 A, 19 R, 22 A, 22 R

[56] References Cited

U.S. PATENT DOCUMENTS

| | | | |
|---|---|---|---|
| 1,282,253 | 10/1918 | Lund | 36/25 R |
| 1,952,687 | 3/1934 | Sawmiller | 36/25 R |
| 2,348,713 | 5/1944 | Davis | 36/25 R |
| 2,380,577 | 7/1945 | Calderazzo | 36/25 R |
| 2,405,870 | 8/1946 | Almy | 36/25 R |
| 2,595,894 | 5/1952 | Sherbrook | 36/22 A |
| 2,629,942 | 3/1953 | Tucceri | 36/22 A |
| 3,406,468 | 10/1968 | Pujol | 36/88 |
| 4,689,898 | 9/1987 | Fahey | 36/88 |

FOREIGN PATENT DOCUMENTS

| | | | |
|---|---|---|---|
| 48965 | 4/1982 | European Pat. Off. | 36/88 |
| 8503624 | 8/1985 | PCT Int'l Appl. | 36/93 |

*Primary Examiner*—Werner H. Schroeder
*Assistant Examiner*—Diana L. Biefeld
*Attorney, Agent, or Firm*—Rogers, Howell & Haferkamp

[57] ABSTRACT

A shoe of California construction having an upper with a sock liner, an outsole, and a midsole between the sock liner and the outsole. The midsole comprises a molded polyurethane element having a lower surface of a contour complementary to the contour of the upper surface of the outsole and having an upper surface of a contour complementary to the shape of the bottom of a wearer's foot. A fiberboard backing sheet is bonded to the lower surface of the midsole. A leather wrap extends between the upper and the outsole and surrounds the side wall, the midsole, following the contoured shape of the midsole side wall.

16 Claims, 1 Drawing Sheet

FIG. 1.
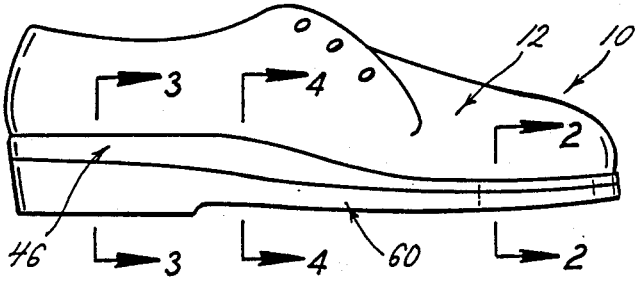
FIG. 2.
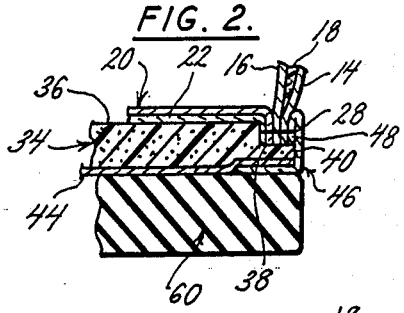
FIG. 3.
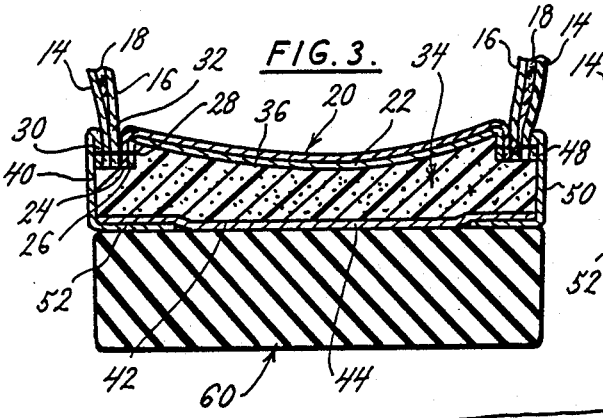
FIG. 4.
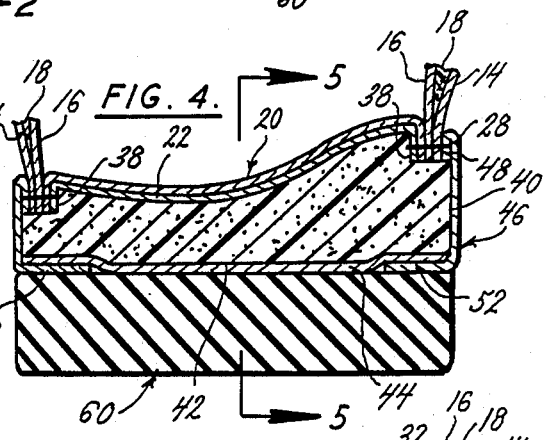
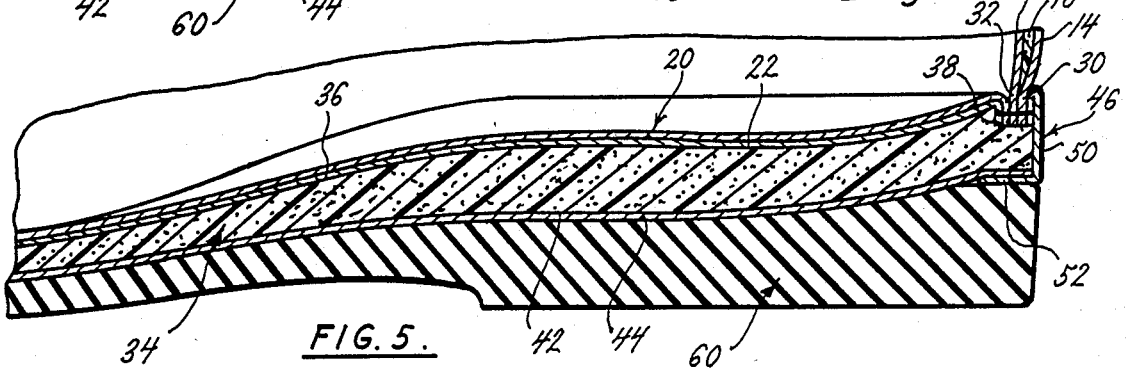
FIG. 5.
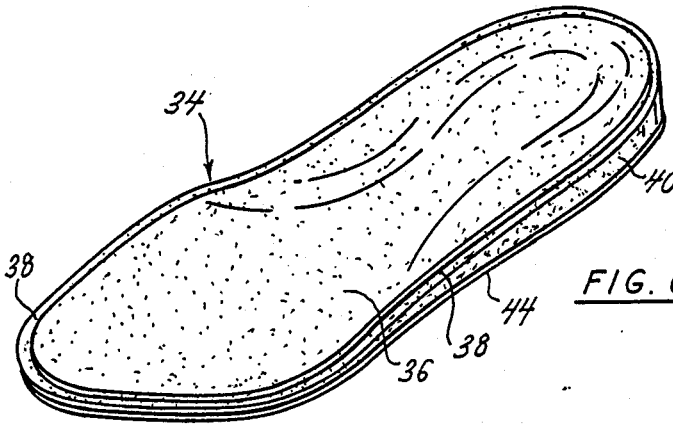
FIG. 6.
FIG. 7.
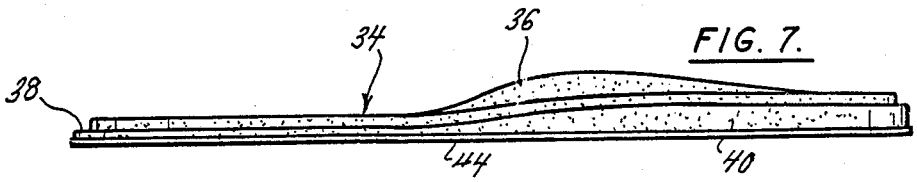

CALIFORNIA TYPE SHOE WITH CONTOURED MIDSOLE

BACKGROUND OF THE INVENTION

This invention relates to a California type shoe having a contoured midsole.

A shoe known as a California type shoe or a shoe of California construction is considered extremely comfortable because it is soft and cushiony to the wearer's foot. In a California type shoe, an upper is stitched to a sock liner, which may or may not be padded, and these components are joined to an outsole. There is no full insole that must bend as the shoe is worn. The combined upper and sock liner form an enclosure for the foot somewhat like a sock. The outsole functions as a platform.

Usually in the California type shoe, the sock liner or insole is attached directly to the outsole by gluing. The outsole typically is of man-made material that is durable to withstand the effects of various kinds of contact with walking surfaces. Therefore, the outsole is not particularly soft or cushiony to the foot. To increase the cushion effect, the sock liner is sometimes formed of split layers enclosing a cushion of sponge material or alternatively a midsole of a cushiony material is incorporated in the shoe.

In both the cushioned sock liner and the cushion midsole, the cushion material is of uniform cross-section, and although the contoured outer sole will provide a contoured shape to the bottom of the foot, the resilience of the sock liner cushion or midsole is uniform over the bottom of the foot rather than varying with the foot contour. Accordingly, enhanced cushioning is not provided to areas of the foot, such as the arch, that most need it. As will appear, the present invention provides significant improvements over the prior art as above described and as represented by the patents which will now be discussed.

U.S. Pat. No. 4,501,076 discloses a shoe that is somewhat similar to a California type shoe. In the shoe of this patent, there is a foam pad midsole, but the midsole is of uniform thickness. U.S. Pat. No. 4,133,118 discloses a shoe having a contoured midsole of cork-latex. The shoe of this patent is not a California type shoe. U.S. Pat. No. 4,685,223 discloses a moccasin type shoe that incorporates a midsole of an unspecified foam. The midsole is of uniform thickness. U.S. Pat. No. 4,112,600 discloses a shoe having a contoured outer sole with an arch support. The shoe is not a California type shoe and there is no midsole. U.S. Pat. No. 3,325,919 discloses a shoe having an inner core surrounding the foot that conforms to the shape of the foot. U.S. Pat. No. 4,306,361 discloses a shoe having a stocking-like upper joined to a contoured outsole. The shoe is not a California type shoe, and there is no midsole.

SUMMARY OF THE INVENTION

The shoe of this invention is a California type having a midsole molded of polyurethane contoured to the shape of the bottom of a foot and having a fiberboard backing. The shoe has panels sewn together to form an upper that has lower edge margins. These lower margins are joined by stitches to the peripheral margins of a sock liner. A leather frame is joined by the stitches to the aforesaid margins of the upper and sock liner. The stitched margins of the upper, sock liner and leather frame are turned downwardly and are received within a peripheral recess molded for that purpose in the midsole. The midsole and the fiberboard backing to which it is bonded is between the sock liner and an outsole. The leather frame is turned downwardly across the peripheral side wall of the midsole, is turned under the fiberboard backing, and is glued in place.

The contoured polyurethane midsole provides long term comfort for the life of the shoe. The polyurethane follows the general shape of the bottom of the foot, making a natural footbed, and its resilience gives it the capability of responding to the pressure pattern of the foot. This positive and yet resilient support reduces foot and leg fatigue as the density of the polyurethane absorbs the shock of shoe impact on an unyieldable surface.

The midsole is of one piece extending from the toe to the heel of the shoe. It is fused to the fiberboard backing for stability. Being a blown cellular structure, the polyurethane is light weight and retains its shape and memory following repeated usage.

Some principal advantages of this shoe over the prior art are enhanced comfort provided by a cushioned footbed cradle, significant reduction of foot and leg muscle fatigue, and fashionable style resulting from functional components. In the latter respect, the leather frame covers the stitched margins of the upper and sock liner to which it is attached and is folded across and glued to the peripheral sides and bottom margins of the midsole. Since the peripheral sides of the midsole suggest the contoured shape, this distinctive suggestion is transferred through the leather frame which adheres to the shape of those peripheral sides.

BRIEF DESCRIPTION OF THE DRAWING

FIG. 1 is a side elevation view of the shoe of this invention;

FIG. 2 is an enlarged view in section taken along the plane of the line 2—2 of FIG. 1.

FIG. 3 is an enlarged view in section taken along the plane of the line 3—3 of FIG. 1;

FIG. 4 is an enlarged view in section taken along the plane of the line 4—4 of FIG. 1;

FIG. 5 is a view in section taken along the plane of the line 5—5 of FIG. 4;

FIG. 6 is a perspective view of the midsole and fiberboard backing sheet on a scale intermediate that of FIG. 1 and FIGS. 2–5; and FIG. 7 is a side elevation view of the midsole and fiberboard backing sheet of FIG. 6.

DETAILED DESCRIPTION OF THE PREFERRED EMBODIMENT

The shoe 10 has an upper 12 that may consist of outer and inner layers 14 and 16 that encase a layer 18 of a sponge material between them. A sock liner 20, preferably of pigskin is laminated to a fabric backer sheet 22 and their outer margins 24 and 26, respectively, are joined by stitches 28 to the lower margins 30 and 32, respectively, of the upper panels 14 and 16.

A midsole 34 that functions as a platform has a contoured upper surface 36 surrounded by a peripheral recess 38. The shape of the contoured upper surface 36 conforms to the shape of the bottom of a wearer's foot. The midsole 34 has a peripheral side wall 40 terminating in a lower surface 42 that is cemented to a fiberboard backing sheet 44, such as Texon.

A leather wrap 46 has an inner downturned margin 48 joined by the stitches 28 to the upper margins 30 and 32 and sock liner and fabric backing sheet margins 24 and 26. The leather wrap 46 is folded downwardly, creating a side wall 50 that covers and is cemented to the stitching area that includes the margin 48 and also covers and is cemented to the peripheral side wall 40 of the midsole 34. The remaining margin 52 of the leather wrap 46 is folded under and cemented to the fiberboard backing sheet 44.

An outsole 60, together with a shank if appropriate or desired (not shown), is cemented to the bottom of the fiberboard backing sheet 44 and the inner margin 52 of the leather wrap 46. Thus, the external appearance of the shoe 10 reveals only the upper 12, the leather wrap 46, and the outsole 60. Yet the peripheral recess 38 receives the stitched margins 24, 26, 30, 32 and 48, leaving the foot comfortably surrounded by the sock like upper and sock liner. The contoured polyurethane midsole 34 provides a resilient comfortable platform for the foot.

In the manufacture of this shoe 10, the upper is formed in a conventional manner. The sock liner 20, leather wrap 46 and upper 12 are joined together by the stitching 28, forming the sock-like foot enclosure. The partially assembled shoe is then put over a last to provide the proper shape.

Meanwhile, the midsole 34 will have been molded. In this process the fiberboard backing strip 44 is put in the mold and the polyurethane is injected and its upper surface 36 is formed by the mold to the contoured shape of the bottom of a foot.

The midsole 34 is cemented to the lasted bottom on the upper-sock liner combination. Then the leather wrap 46 is cemented to the peripheral side 40 of the midsole 34 and to the bottom of the fiberboard backing sheet 44. Cementing the outsole 60 to the fiberboard backing sheet 44 completes the shoe construction.

There are various changes and modifications which may be made to the invention as would be apparent to those skilled in the art. However, these changes or modifications are included in the teaching of the disclosure, and it is intended that the invention be limited only by the scope of the claims appended hereto.

I claim:

1. A shoe comprising an upper, a sock liner, an outsole, and a midsole between the sock liner and the outsole, means for joining the upper and the sock liner to the midsole and means for joining the midsole to the outsole, the midsole comprising a molded element of polyurethane or the like having a lower surface of a contour complementary to the contour of the upper surface of the outsole and having an upper surface of a molded to the contoured shape of the bottom of a wearer's foot, the sock liner following the contour of the upper surface of the midsole.

2. The shoe of claim 1 including a stiff backing sheet between the midsole and the outsole.

3. The shoe of claim 2 wherein the stiff backing sheet is fiberboard and is cemented to the bottom surface of the midsole.

4. The shoe of claim 2 including a leather wrap having an upper edge joined to the upper and a lower margin joined to the outsole and wherein the backing sheet overlies the lower margin of the wrap.

5. The shoe of claim 1 wherein the upper has a lower margin joined to outer margins of the sock liner by stitching.

6. The shoe of claim 5 wherein the midsole has a peripheral recess for receiving the stitched margins.

7. The shoe of claim 6 including a leather wrap having a margin joined to the upper and sock liner margins by said stitching and has an area covering the stitching as well as the peripheral side wall of the midsole.

8. The shoe of claim 7 wherein the wrap has a margin between the midsole and the outsole.

9. A California type shoe comprising an upper assembly for generally enclosing a foot, a midsole cemented to the bottom of the upper assembly, and an outsole joined to the bottom of the midsole, the midsole comprising a molded member of polyurethane or the like having an upper surface molded to the contoured shape of the bottom of a foot.

10. The shoe of claim 9 including a fiberboard backing strip bonded to the bottom of the midsole, the outsole being bonded to the bottom of the fiberboard backing strip.

11. The shoe of claim 9 wherein the upper assembly comprises an upper and a sock liner, each having downturned margins joined together by stitching, a peripheral recess in the midsole for receiving said downturned margins, and a wrap secured about the midsole covering said margins and the peripheral side wall of the midsole.

12. A shoe comprising:

an upper, a sock liner, an outsole, a midsole between the sock liner and the outsole and having a groove around its peripheral edge; wherein, a lower margin of the upper and an outer margin of the sock liner are joined together and inserted into the midsole groove.

13. The shoe of claim 12 further comprising:

a wrap having an upper margin joined with the lower margin of the upper and the outer margin of the sock liner and inserted into the midsole groove.

14. The shoe of claim 13 further comprising:

the wrap being folded over and covering the join of the upper, sock liner and wrap margins.

15. The shoe of claim 12 further comprising:

the midsole being of non-uniform thickness with a bottom surface shaped to complement a top surface of the outsole and a top surface shaped to complement the bottom of a wearer's foot.

16. The shoe of claim 13 further comprising:

the wrap covering the sides of the midsole and having a lower margin inserted between the bottom surface of the midsole and the top surface of the outsole.

* * * * *